US005428708A

United States Patent [19]

Gibson et al.

[11] Patent Number: 5,428,708

[45] Date of Patent: Jun. 27, 1995

[54] MUSICAL ENTERTAINMENT SYSTEM

[75] Inventors: Brian C. Gibson; John P. Bertsch, both of Victoria, Canada

[73] Assignee: IVL Technologies Ltd., British Columbia, Canada

[21] Appl. No.: 848,035

[22] Filed: Mar. 9, 1992

Related U.S. Application Data

[63] Continuation-in-part of Ser. No. 719,195, Jun. 21, 1991.

[51] Int. Cl.[6] ..... G10L 3/00

[52] U.S. Cl. ..... 395/2.79; 395/2.16; 395/2.85

[58] Field of Search ..... 381/34, 38, 49; 395/2.79, 2.85, 2, 2.16, 2.2–2.22

[56] References Cited

U.S. PATENT DOCUMENTS

| | | | |
|---|---|---|---|
| 5,08,390 | 9/1991 | Adachi et al. | 84/464 R |
| 3,539,701 | 7/1967 | Milde | 84/641 |
| 3,929,051 | 12/1975 | Moore | 84/682 |
| 3,986,423 | 10/1976 | Rossum | 84/692 |
| 3,999,456 | 12/1976 | Tsunoo et al. | 84/681 |
| 4,076,960 | 1/1978 | Buss et al. | 395/2 |
| 4,081,607 | 3/1978 | Vitols et al. | 395/2.46 |
| 4,142,066 | 2/1979 | Ahamed | 381/47 |
| 4,279,185 | 7/1981 | Alonso | 84/603 |
| 4,311,076 | 1/1982 | Rucktenwald | 84/713 |
| 4,387,618 | 6/1983 | Simmons, Jr. | 84/637 |
| 4,464,784 | 8/1984 | Agnello | 381/61 |
| 4,508,002 | 4/1985 | Hall et al. | 84/613 |
| 4,519,008 | 5/1985 | Takenouchi et al. | 360/79 |
| 4,596,032 | 6/1986 | Sakurai | 395/2.67 |
| 4,688,464 | 8/1986 | Gibson et al. | 84/454 |
| 4,771,671 | 9/1988 | Hoff, Jr. | 84/645 |
| 4,802,223 | 1/1989 | Lin et al. | 395/2.16 |
| 4,915,001 | 4/1990 | Dillard | 84/600 |
| 4,991,218 | 2/1991 | Kramer | 381/61 |
| 4,995,026 | 2/1991 | Makabe et al. | 369/70 |
| 5,005,204 | 4/1991 | Deaett | 395/2.67 |
| 5,054,360 | 10/1991 | Lisle et al. | 84/645 |
| 5,056,150 | 10/1991 | Yu et al. | 381/43 |
| 5,092,216 | 3/1992 | Wadhams | 84/602 |
| 5,131,042 | 7/1992 | Oda | 381/34 |
| 5,231,671 | 7/1993 | Gibson et al. | 395/2 |

FOREIGN PATENT DOCUMENTS

| | | |
|---|---|---|
| 2094053 | 9/1982 | United Kingdom . |
| WO90/03640 | 4/1990 | WIPO . |

OTHER PUBLICATIONS

Rupert C. Neberle et al., "CAMP: Computer-Aided Music Processing," *Computer Music Journal*, vol. 15, No. 2, Summer 1991, pp. 33–40.

W. F. McGee et al., "A Real-Time Logarithmic-Frequency Phase Vocoder," *Computer Music Journal*, vol. 15, No. 1, Spring 1991, pp. 20–27.

Lent, K., "An Efficient Method for Pitch Shifting Digitally Sampled Sounds", *Computer Music Journal*, vol. 13, No. 4, Winter 1989.

*Primary Examiner*—David D. Knepper

*Attorney, Agent, or Firm*—Christensen, O'Connor, Johnson & Kindness

[57] ABSTRACT

A karaoke type system allows a participant to sing on key with a prerecorded song. A microphone produces an input signal that corresponds to a singer's voice, and a pitch corrector samples the input vocal signal and determines its pitch. The pitch corrector reads a series of codes that are stored with the prerecorded song that indicates the pitch at which the input vocal signal is to be sung in order to be on key with the prerecorded song. The pitch corrector shifts the pitch of the input vocal signal to be on key.

18 Claims, 12 Drawing Sheets

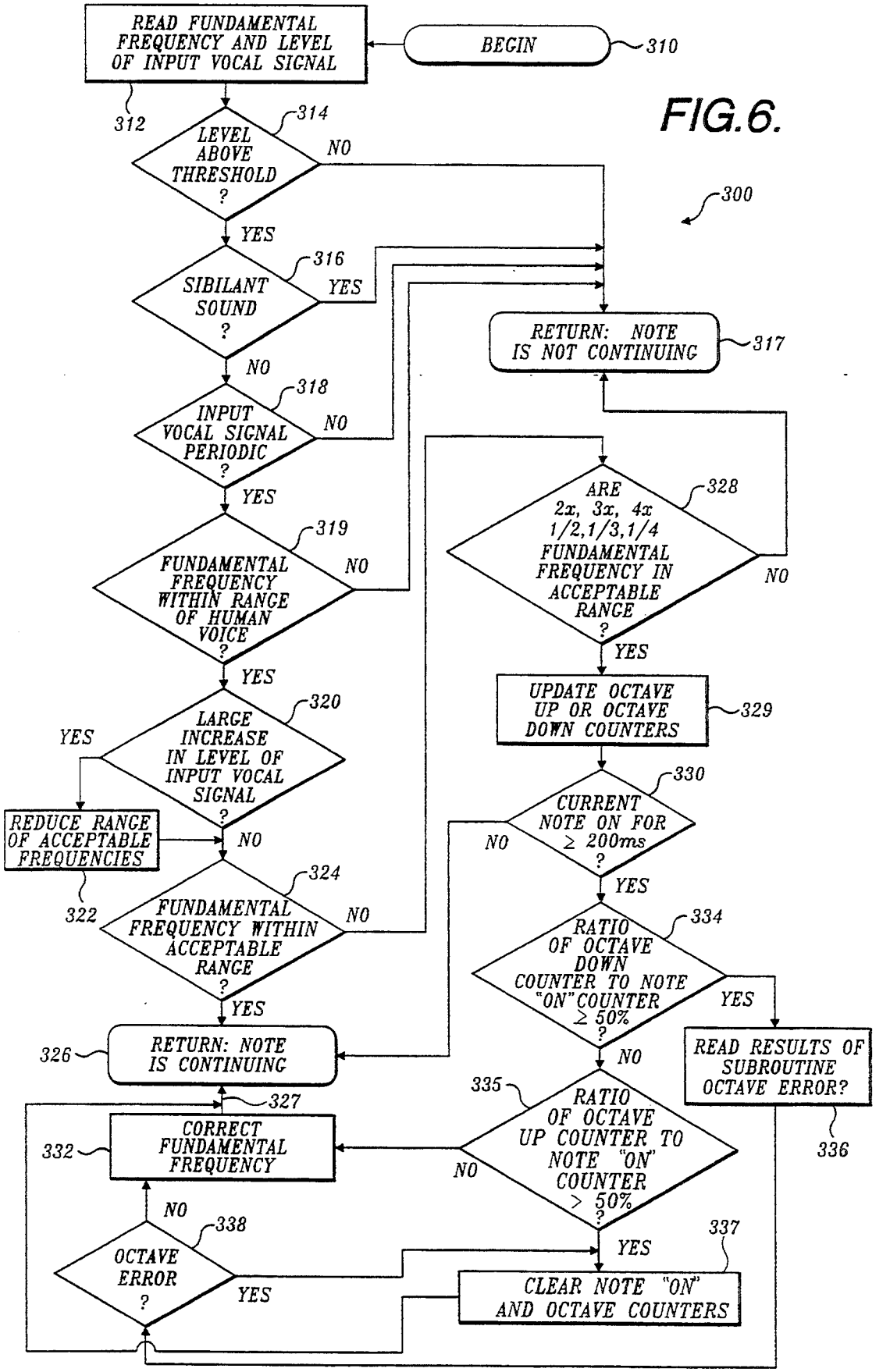
FIG.6.
300
BEGIN
310
READ FUNDAMENTAL FREQUENCY AND LEVEL OF INPUT VOCAL SIGNAL
312
LEVEL ABOVE THRESHOLD ?
314
NO
YES
SIBILANT SOUND ?
316
YES
NO
INPUT VOCAL SIGNAL PERIODIC ?
318
NO
YES
FUNDAMENTAL FREQUENCY WITHIN RANGE OF HUMAN VOICE ?
319
NO
YES
LARGE INCREASE IN LEVEL OF INPUT VOCAL SIGNAL ?
320
YES
REDUCE RANGE OF ACCEPTABLE FREQUENCIES
322
NO
FUNDAMENTAL FREQUENCY WITHIN ACCEPTABLE RANGE ?
324
NO
YES
RETURN: NOTE IS CONTINUING
326
327
CORRECT FUNDAMENTAL FREQUENCY
332
NO
OCTAVE ERROR ?
338
YES
RETURN: NOTE IS NOT CONTINUING
317
ARE 2x, 3x, 4x 1/2,1/3,1/4 FUNDAMENTAL FREQUENCY IN ACCEPTABLE RANGE ?
328
NO
YES
UPDATE OCTAVE UP OR OCTAVE DOWN COUNTERS
329
CURRENT NOTE ON FOR ≥ 200ms ?
330
NO
YES
RATIO OF OCTAVE DOWN COUNTER TO NOTE "ON" COUNTER ≥ 50% ?
334
YES
NO
READ RESULTS OF SUBROUTINE OCTAVE ERROR?
336
RATIO OF OCTAVE UP COUNTER TO NOTE "ON" COUNTER > 50% ?
335
NO
YES
CLEAR NOTE "ON" AND OCTAVE COUNTERS
337

MUSICAL ENTERTAINMENT SYSTEM

RELATED APPLICATION

This application is a continuation-in-part of U.S. patent application Ser. No. 07/719,195, filed Jun. 21, 1991.

FIELD OF THE INVENTION

The present invention relates generally to entertainment systems and, in particular, to musical entertainment systems wherein a participant sings along with a prerecorded song.

BACKGROUND OF THE INVENTION

One of the newest forms of entertainment to become popular in Japan and the United States is karaoke. A karaoke machine typically comprises a stereo sound system and a large video monitor or television screen. A videotape or videodisc player is coupled to the video monitor to simultaneously play a music video while a musical song that lacks a vocal track is played on the stereo system. As the music video is played on the video monitor, the words of the song are displayed at the same time as they are to be sung. A microphone is also coupled to the stereo system so that a participant can sing the words of the song being played as the music video is shown.

Not surprisingly, the quality of such impromptu singing performances varies greatly depending on the singing ability of the participant. As a result, many people are hesitant to stand up and sing in front of a crowd of friends and/or hecklers. This hesitation is usually due to a perceived lack of talent on the part of the "would be participant." However, some people, despite words of encouragement, are not blessed with the ability to remain on pitch with a musical accompaniment being played. Therefore, a need exists for an entertainment system that can alter the pitch of the notes sung by a participant to correspond to the proper pitch of the song being played.

Prior to the present invention, inexpensive equipment has not been available to alter the pitch of a vocal signal in a way that sounds natural. While musical pitch shifters that can alter the pitch of a signal produced by a musical instrument such as a guitar or synthesizer have been well known for many years, such devices do not work well on vocal sounds.

In any periodic musical signal, there is always a fundamental frequency that determines the particular pitch of the signal as well as numerous harmonics, which give character to the musical note. It is the particular combination of the harmonic frequencies with the fundamental frequency that make, for example, a guitar and a violin playing the same note sound different from one another. In a musical instrument such as a guitar, flute, saxophone or a keyboard, as the notes played by the instrument vary, the spectral envelope containing the fundamental frequency and the harmonics expands or contracts correspondingly. Therefore, for musical instruments one can alter the pitch of a note by sampling sound from the instrument and playing the sampled sound back at a rate either faster or slower, without the pitch-shifted notes sounding artificial. Although this method works well to shift the pitch of a note from a musical instrument, it does not work well for shifting the pitch of a vocal signal or sung note.

In a vocal signal, there is typically a fundamental frequency that determines the pitch of a note an individual is singing, as well as a set of harmonic frequencies that add character and timbre to the note. In contrast with a musical instrument, as the pitch of a vocal signal varies, the spectral envelope of the harmonics retains the same shape but the individual frequency components that make up the spectral envelope may change in magnitude. Therefore, shifting the pitch of a vocal signal by sampling a note as it is sung and by playing back the sampled signal at a rate that is either faster or slower does not sound natural, because that method varies the shape of the spectral envelope. In order to alter the pitch of a vocal note in a way that sounds natural, a method is required for varying the frequency of the fundamental, while maintaining the overall shape of the spectral envelope.

The inventors have found that the method, as set forth in the article by K. Lent, "An Efficient Method for Pitch Shifting Digitally Sampled Sounds," Computer Music Journal, Volume 13, No. 4, Winter, pp. 65–71 (1989) (hereafter referred to as the Lent method), is particularly suited for use in shifting the pitch of a vocal signal because the method maintains the shape of the spectral envelope. However, the actual implementation of the Lent method, as set forth in the referenced paper, is computationally complex and difficult to implement in real time with inexpensive computing equipment. Additionally, the Lent method requires that the fundamental frequency of a signal be known exactly. Unfortunately, this is a problem because vocal signals are difficult to analyze. More specifically, because the fundamental frequency of a given note when sung may vary considerably, it is difficult for a pitch shifter to accurately determine the fundamental frequency. The Lent method does not address the problem of accurately determining the fundamental frequency of a complex vocal signal.

Therefore, there exists a need for a method and apparatus for shifting the pitch of a vocal signal that can operate substantially in real time and be implemented with inexpensive computing equipment. This method and apparatus should be able to quickly analyze an input vocal signal and compare it to a Reference Note that corresponds to the "correct" pitch of the song being played. The method and apparatus should then shift the pitch of the input vocal signal so that it is on pitch with the Reference Note in a way that sounds natural.

SUMMARY OF THE INVENTION

In accordance with the present invention, a Karaoke-type entertainment system is provided. The system comprises a stereo system and a video monitor. A video player provides a video signal to the video monitor to play a "music video" as a musical accompaniment signal that lacks a vocal track is played on the stereo system. Included in the video signal are the words of the song as they are to be sung to the accompaniment. A microphone is coupled to the stereo system so that a participant can sing the words shown on the video monitor as the musical accompaniment is played on the stereo system.

The entertainment system of the present invention further includes a pitch corrector that determines the pitch of an input note sung by a participant and compares it with the pitch of a Reference Note received from the video player. If the pitch of the input note sung by the participant is not equivalent to the pitch of the Reference Note, the pitch corrector shifts the pitch of the input note so that the pitch substantially equals the pitch of the Reference Note. The pitch-shifted note is applied to an input of the stereo system and played with the musical accompaniment signal so that it sounds like the participant is singing the words of the song on pitch.

In accordance with a further aspect of the invention, the musical accompaniment and the Reference Notes are stored on a computer storage device such as a floppy disc. A sequencer computer reads the musical accompaniment signal and drives a synthesizer to play the accompaniment. The sequencer computer also reads the Reference Notes from the computer storage device and transmits them to the pitch corrector so the pitch corrector can adjust the pitch of the input note sung by the participant to equal the pitch of the Reference Notes. With the present inventive entertainment system, it is possible to boost the performance level of even the most mediocre of singers.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 6 is a flow chart showing the steps of a method for determining if a note is continuing;

DETAILED DESCRIPTION OF THE PREFERRED EMBODIMENT

Figure 1:
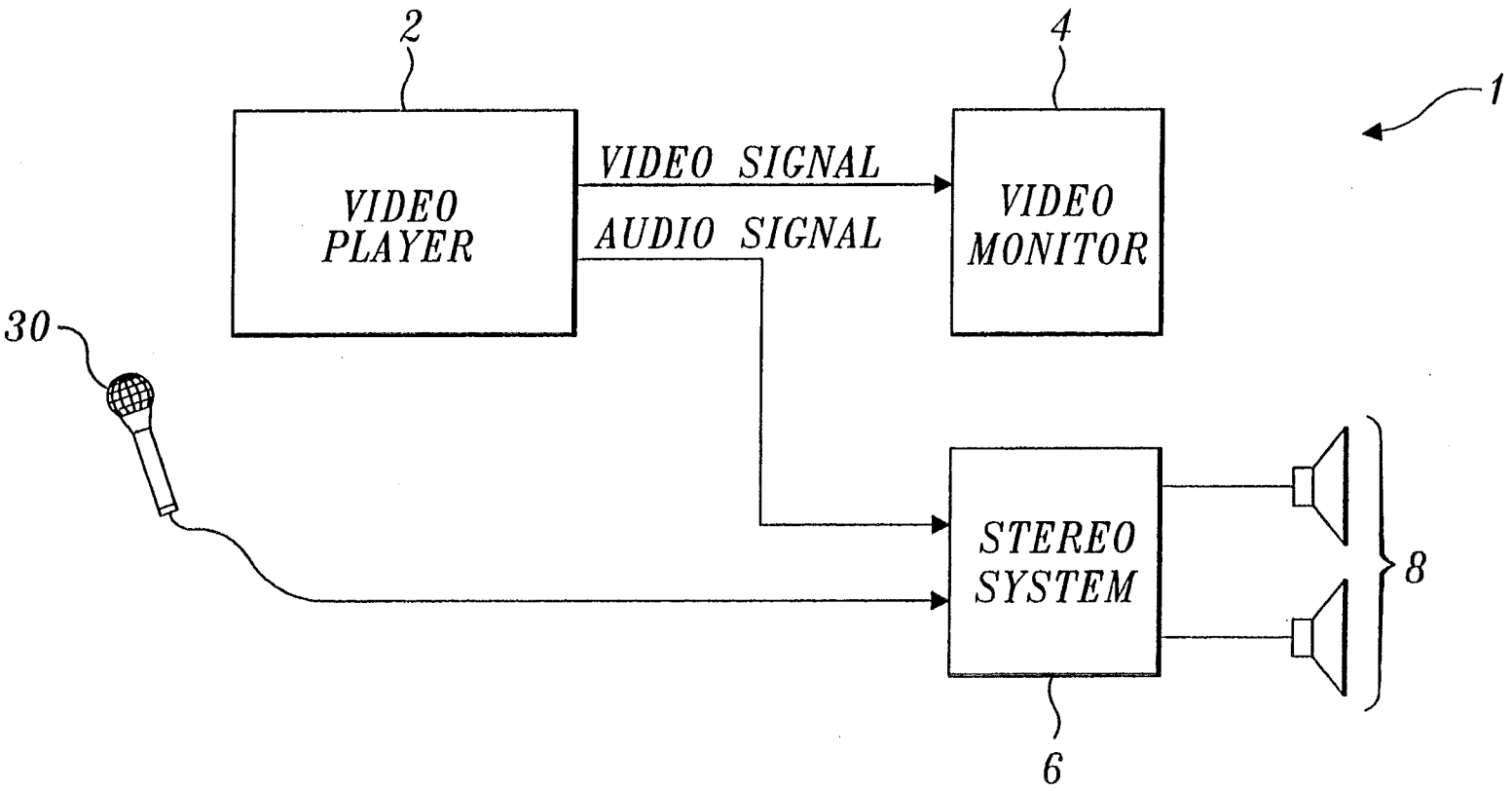
FIG. 1. (PRIOR ART)
FIG. 1 is a block diagram of a typical karaoke entertainment system.

To illustrate the environment in which the present invention is used, a block diagram of a typical karaoke machine is shown in FIG. 1. The karaoke system 1 includes a video player 2, a video monitor 4, a stereo system 6 and a microphone 30. The video player has two outputs leads. The first lead carries a video signal from the video player 2 to the video monitor 4, while the second lead carries an audio signal from the video player 2 to the stereo system 6. The microphone 30 is coupled to an input of the stereo system 6.

As the karaoke system is used, a participant or disk jockey selects a music video of a song to be played and inserts the video in the video player 2. As the music video is shown on the video monitor, the words of the song are displayed for a participant to sing. The participant is given the microphone 30, and his or her singing is combined with the audio signal (i.e., the background music of the song) and played by the stereo system through a set of speakers 8. As described above, the quality of the performance given by the participant is largely dependent on the singing ability of the participant. The present invention seeks to adjust the pitch of the notes sung by the participant so that the participant sings on pitch with the song being played.

Figure 2:
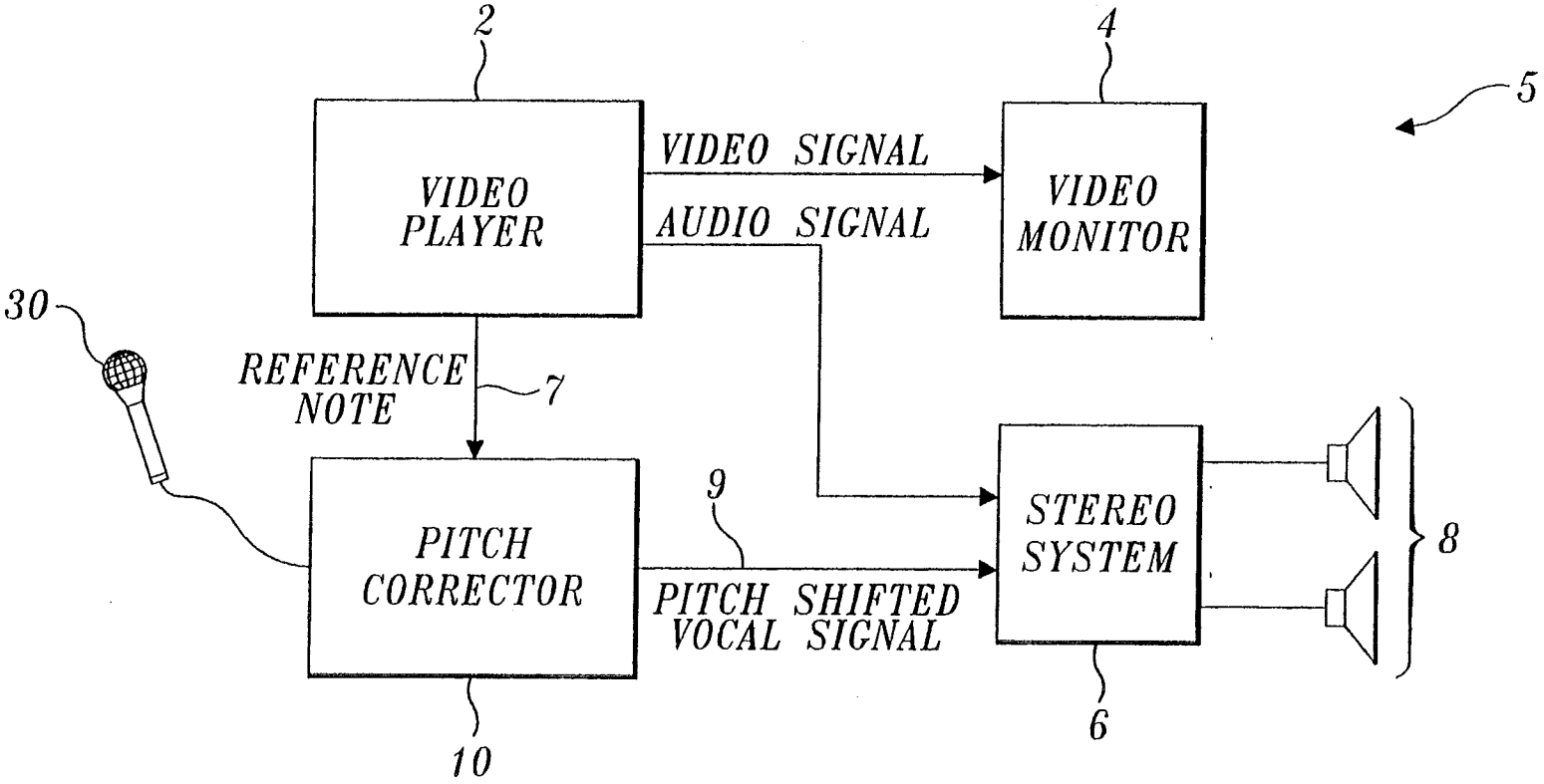
FIG. 2 is a block diagram of a karaoke entertainment system according to the present invention.

FIG. 2 is a block diagram of a karaoke system 5 according to the present invention. The system 5 is configured in the same way as the system shown in FIG. 1 with the addition of a pitch corrector 10. The pitch corrector 10 is disposed between the microphone 30 and the stereo system 6. The pitch corrector receives an input vocal signal sung by the participant from the microphone 30 and determines the pitch of the input vocal signal. The pitch corrector then compares the pitch of the input vocal signal to the pitch of a Reference Note received on a lead 7 that extends from the video player 2 or some other source to an input of the pitch corrector. Preferably, the Reference Notes are stored as a subcode on a laser disk or a videotape in a MIDI (Music Interactive Digital Interface) format. It is to be understood that the present invention is not intended to be limited to a karaoke entertainment system that uses a video player as the source of the Reference Notes; other types of entertainment systems can also benefit from the use of a pitch corrector of the type contemplated by the invention. In this regard, any source of digital information such as a MIDI-compatible keyboard, guitar synthesizer, or ROM card can be used to provide Reference Notes to the pitch corrector.

The pitch corrector 20 compares the pitch of the input vocal signal received from the microphone 30 with the pitch of the Reference Notes and shifts the pitch of the input vocal signal so that it is "on pitch" with the Reference Note. The pitch-shifted vocal signal is applied to an input of the stereo system 6 on a lead 9. Therefore, the resultant sound produced by the stereo system 6 is the accompaniment signal and a pitch-shifted input vocal signal that is "on pitch" with the accompaniment.

Figure 3:
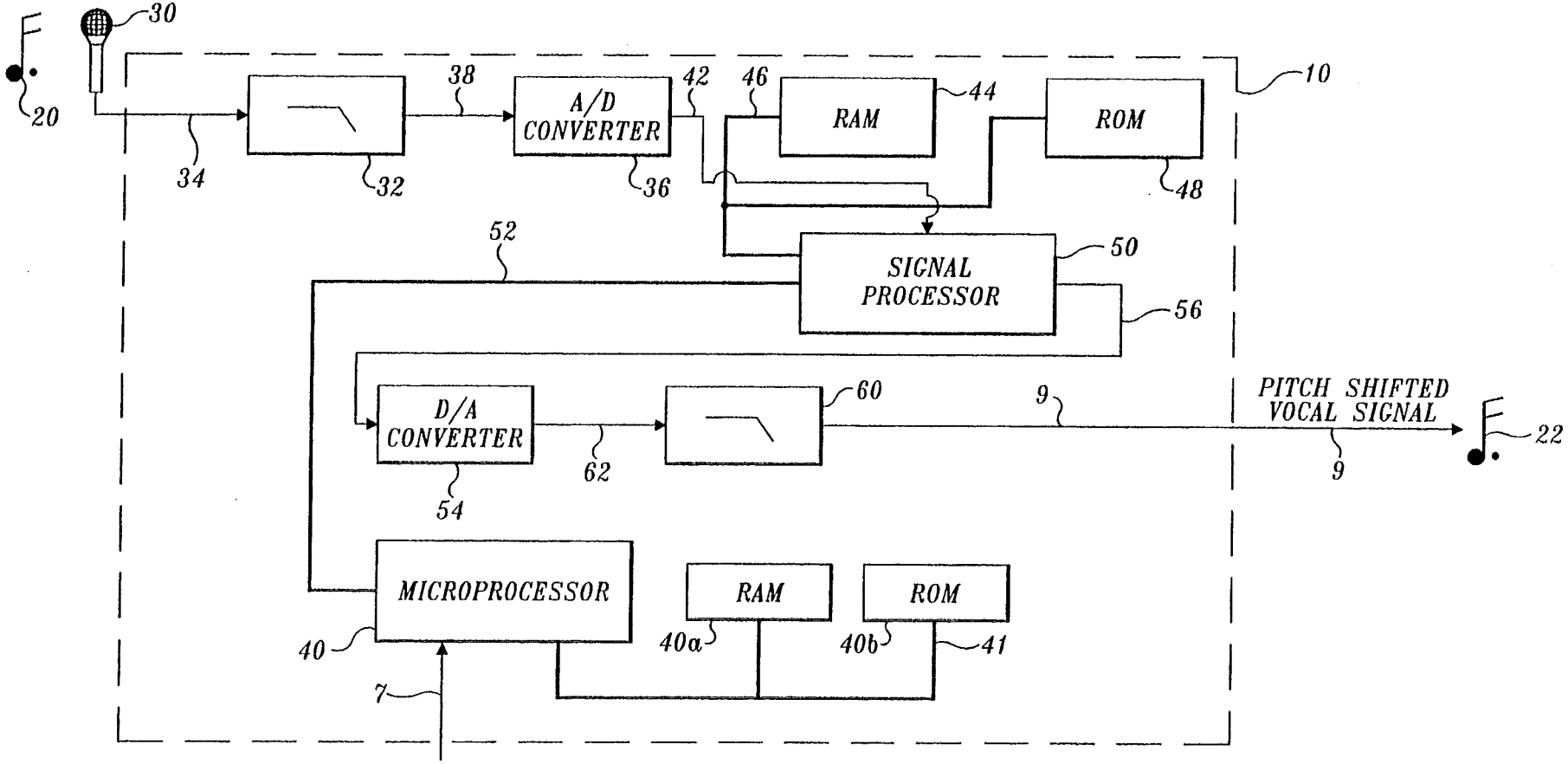
FIG. 3 is a block diagram of a pitch corrector according to the present invention.

FIG. 3 is a block diagram of a pitch corrector 10 according to the present invention. The pitch corrector 10 receives an input vocal signal 20 and produces a pitch-shifted output vocal signal 22 on the lead 9. The pitch corrector 10 receives the input vocal signal 20 from a microphone 30 or from another source, such as a tape recorder, which produces an electrical signal representative of an input vocal signal. The input vocal signal is first applied to an input filter 32 on a lead 34. The filter 32 preferably comprises an anti-aliasing filter that reduces the magnitude of any high-frequency noise signals picked up by the microphone 30. After being filtered by the filter 32, the input vocal signal 20 is converted from an analog format to a digital format by an analog-to-digital (A/D) converter 36, which is coupled to the output of the filter 32 by a lead 38.

The output of the A/D converter 36 is coupled to a signal processor 50 by a lead 42. The signal processor block 50 receives the digitized input vocal signal on a lead 42 and stores it in a circular array included within a random access memory (RAM) 44. The RAM 44 and a read-only memory (ROM) 48 are coupled to the signal processor block 50 by a bus 46.

The signal processor block 50 shifts the pitch of the input vocal signal by extracting a portion of the input vocal signal 20 stored in the RAM 44 and by replicating the extracted portion at a rate substantially equal to the fundamental frequency of the Reference Note, as will be described below. It should be noted that the term "pitch" and "fundamental frequency" of a note, as used in this specification, are synonymous. Similarly, the period of a note is simply the inverse of the fundamental frequency or pitch as is well known to those skilled in the art of musical electronics.

A bus 52 couples the signal processor 50 to a microprocessor 40 so that the microprocessor can supply a set of parameters used by the signal processor 50 to shift the pitch of the input vocal signal. The microprocessor 40 preferably is an eight-bit architecture-type chip, Model No. 8OC31, made by Intel Corporation. Coupled to the microprocessor 40 by a bus 41 are an external random-access memory (RAM) **40*a* and an external read-only memory (ROM) 40*b*. The signal processor 50 transfers data stored in the RAM 44 to the microprocessor 40** according to a variety of methods as will be readily apparent to those skilled in the art.

The output of the signal processor 50 is coupled to a digital-to-analog (D/A) converter 54 by a lead 56. The D/A converter 54 converts the pitch-shifted vocal signal from a digital format to an analog format. The output signal of the D/A converter 54 is in turn coupled by a lead 62 to a reconstruction filter 60. The reconstruction filter removes any high-frequency noise signals that may have been added to the pitch-shifted vocal signal by the signal processor 50. The filtered, pitch-shifted output vocal signal is output from the pitch corrector 10 on the lead 9.

Figure 4:
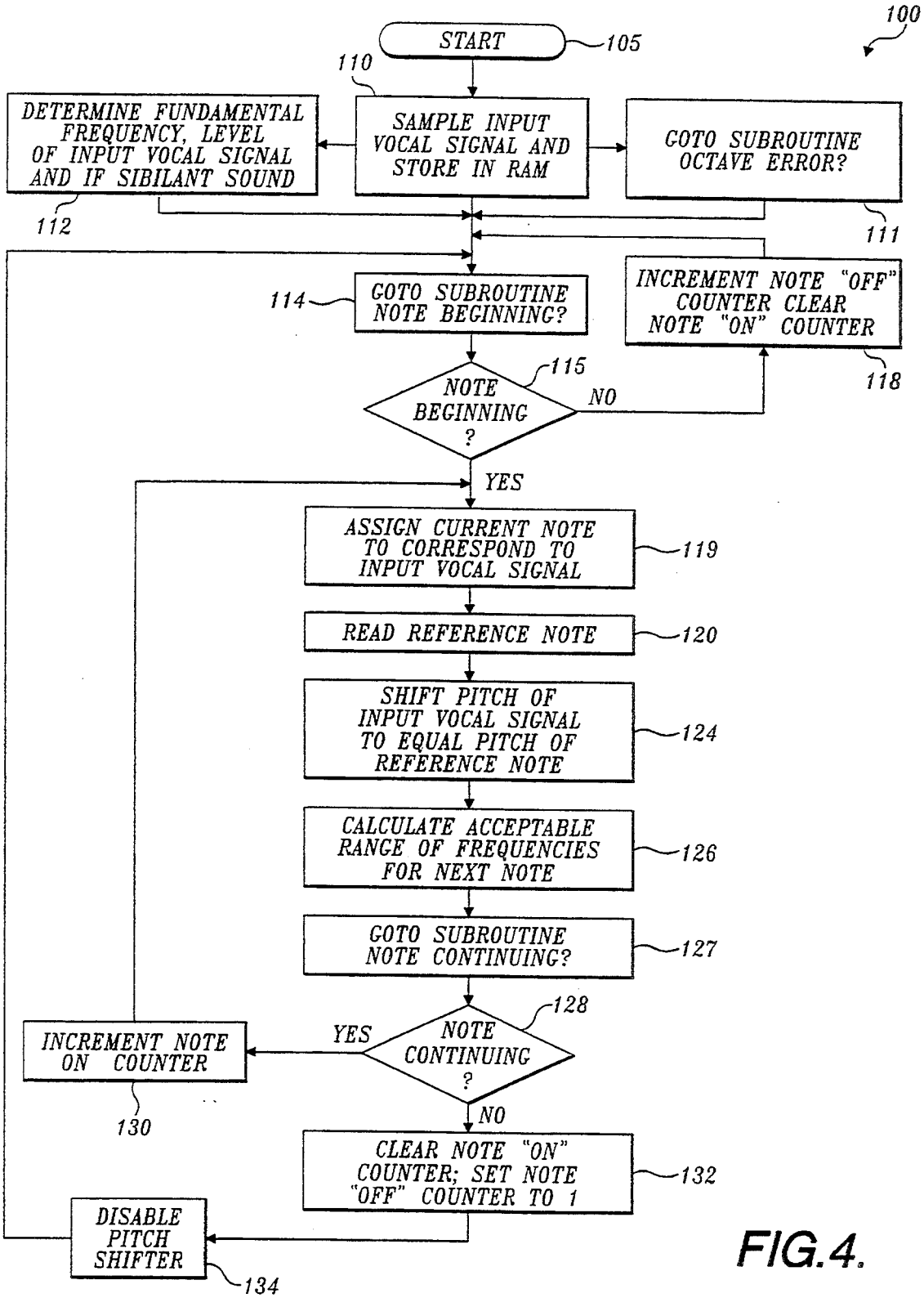
FIG. 4 is a flow chart illustrating the steps of a method for shifting the pitch of an input vocal signal according to the present invention.

FIG. 4 illustrates the steps of a method, shown generally at 100, for analyzing an input vocal signal and for shifting the pitch of the input vocal signal according to the present invention. The method begins at a start block 105 and proceeds to block 110, wherein the input vocal signal is sampled and stored in the circular array contained within RAM 44 shown in FIG. 3. Operating "in parallel" with and independently of block 110 are two subroutines shown in blocks 111 and 112. In block 112 an estimation is made of the fundamental frequency of the input vocal signal, the level of the input vocal signal, and whether the input vocal signal is periodic. If the input signal is not periodic, block 112 returns an indication that the input vocal signal is nonperiodic as well as an indication of whether the input vocal signal is representative of a sibilant sound. Sibilant sounds are sounds like "sh," "ch," "s," etc. For a pitch-shifted vocal signal to sound natural, the pitch of these types of sounds should not be shifted. Therefore, it is necessary to detect them and bypass the pitch-shifting algorithm, as will be described below. The operation of block 112, i.e., how the estimate of the fundamental frequency and the estimate of the level of the input vocal signal are made, is fully described in commonly assigned U.S. Pat. No. 4,688,464. Briefly, block 112 determines the fundamental frequency of the input vocal signal based upon the time the input vocal signal takes to cross a set of alternate positive and negative thresholds. How the present invention detects the presence of a sibilant sound is fully described below.

The block 111, which also operates "in parallel" with block 110, calls "an octave error" subroutine 400. As will also be further described below, the octave error subroutine 400 determines if the fundamental frequency of the input vocal signal, determined by block 112, is an octave lower than the actual fundamental frequency of the input vocal signal. While the Lent method works well for shifting the pitch of a vocal signal, it is particularly sensitive to octave errors wherein a wrong determination is made of what octave a particular note is being sung. Therefore, additional checks are made to ensure that a correct octave determination has been made. Blocks 111 and 112 are routines that continually run during the implementation of the method 100.

After block 110, the method proceeds to a block 114, which calls a "note beginning" subroutine 200. The note beginning subroutine 200 determines if the input vocal signal sampled in block 110 marks the beginning of a new note sung by the participant. The results of the subroutine 200 are tested in decision block 115. If the answer to decision block 115 is no, meaning that a new note is not beginning, the method proceeds to block 118, where a note "off" counter is incremented and a note "on" counter is cleared. The note "off" counter keeps track of the length of time since the last note was sung into the pitch corrector. Similarly, the note "on" counter keeps track of the length of time a Current Note has been sung by the participant. These counters help in determining what note a participant is singing as will be further described below. After block 118, the method loops back to block 114 until the answer from decision block 115 is yes.

Once it is determined, by decision block 115, that a note is beginning, the method proceeds to block 119 wherein a variable, Current Note, is assigned to correspond to the pitch of the input vocal signal. For example, if the input vocal signal had a fundamental frequency of approximately 440 Hertz, the method would assign note A to the variable Current Note. The pitch of the Current Note is then used for comparison against the pitch of a Reference Note supplied by the video player (not shown).

To determine which musical note is assigned to the variable, Current Note, a look-up table stored in the external ROM **40*b* shown in FIG. 3** is used. Contained within the look-up table are the notes of an equal tempered scale stored as ranges of fundamental frequencies. Therefore, for any given input signal, there will be a corresponding note from the table that will be assigned to the variable Current Note. In the preferred embodiment, the range of frequencies that corresponds to a given note extends ±50 cents (hundredths of a semitone) on either side of the fundamental frequency to allow for slight variations in the fundamental frequency of the input vocal signal when assigning the Current Note. For example, if the participant were singing flat, such that the input vocal signal had a fundamental frequency of 435 Hertz, the method would still assign note A to the variable Current Note.

After block 119, the method proceeds to block 120, wherein the Reference Note is read. As described above, the Reference Note is received by the microprocessor from the video player on a lead 7 shown in FIG. 3. However, other sources could be used to supply the Reference Notes such as a MIDI-compatible sequencer, etc. After reading the Reference Note, the method proceeds to a block 123 wherein the pitch of the stored input vocal signal is shifted to the pitch of the Reference Note. The operation of block 124 is described in further detail below.

After block 124, the method proceeds to block 126, wherein an acceptable range of frequencies for the next note is determined. In the preferred embodiment, once the variable Current Note is assigned to correspond to the fundamental frequency of the input vocal signal in block 119, the acceptable range of fundamental frequencies is initially set to be the fundamental frequency of the Current Note ±25 percent. By assigning an acceptable range of frequencies for a next note, a more educated assignment can be made each time for the Current Note. This logic is based upon the assumption that a human voice is capable of changing notes only at a limited rate. Therefore, if the fundamental frequency as determined by the block 112 falls outside of the acceptable range of frequencies by ±25 percent, the method assumes that the fundamental frequency reading from block 112 is in error.

After block 126, the method proceeds to block 127 that calls a "note continuing" subroutine 300, which determines if the Current Note is continuing to be sung by the participant or has ended. The operation of subroutine 300 is fully described below. Upon returning from subroutine 300, a decision block 128 tests the results of subroutine 300. If the answer to decision block 128 is yes, the method proceeds to block 130, which increments the note "on" counter. After block 130, the method loops back to block 119, and reassigns the variable Current Note to be the fundamental frequency of the input vocal signal. If the answer to decision block 128 is no, the method proceeds to block 132, wherein the note "on" counter is cleared, and the note "off" counter is set to one. After block 132, the method proceeds to a block 134 in which a pitch shifter (not shown) is disabled. After block 134, the method loops back to block 114 in order to begin looking for a new note in the input vocal signal. The method 100 continues looking for a new note to begin in the input vocal signal, assigning a value to the Current Note, reading the Reference Note, comparing the pitch of the Current Note to the pitch of the Reference Note, and shifting the pitch of the Current Note to equal the pitch of the Reference Note as long as the song that the participant is singing continues.

Figure 5:
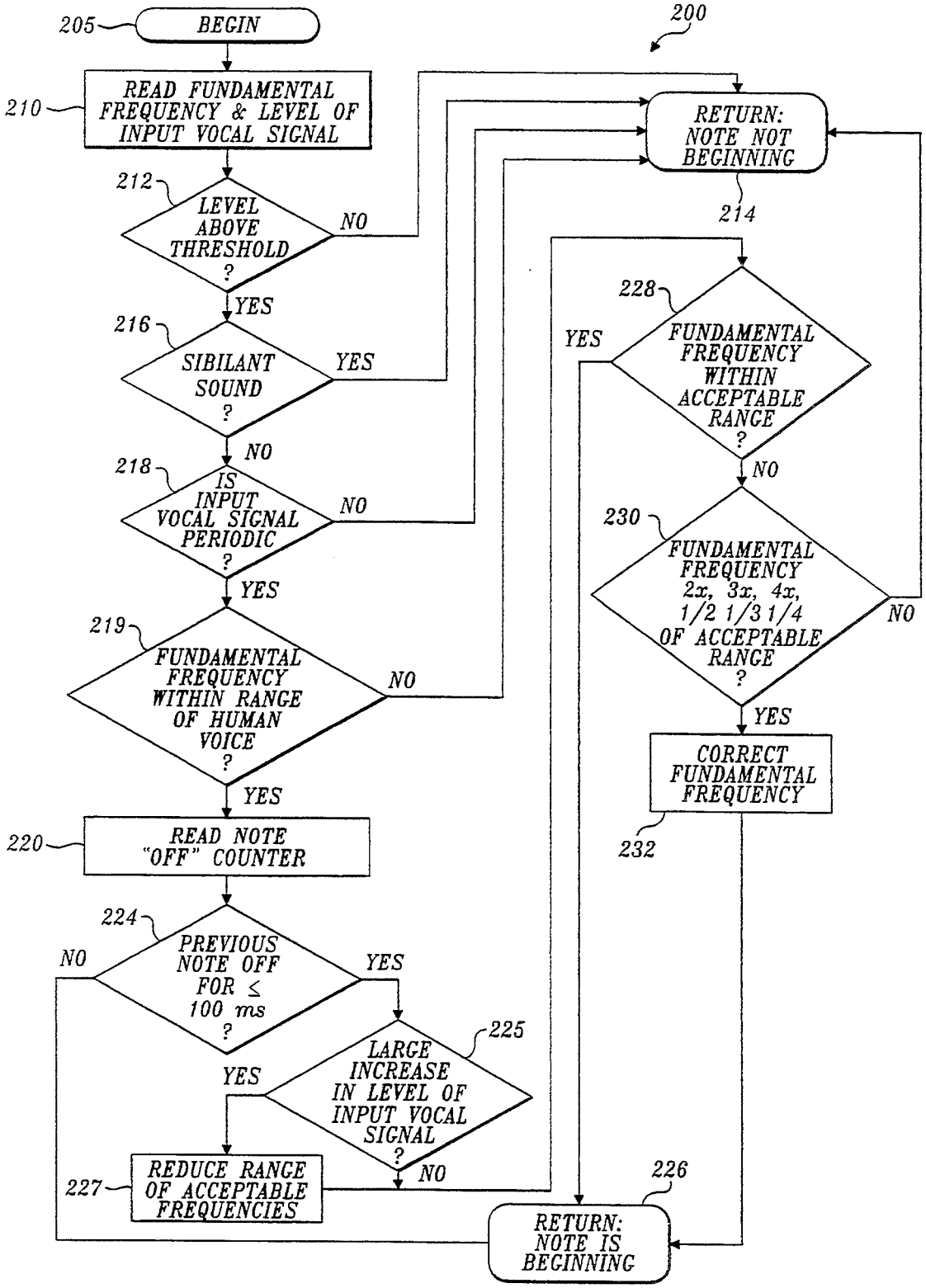
FIG. 5 is a flow chart showing the steps of a method for determining if a note is beginning.

FIG. 5 is a flow chart of the "note beginning" subroutine 200 (shown in block 114 in FIG. 4), which determines if the participant is singing a new note. Subroutine 200 begins at block 205 and proceeds to block 210, wherein the fundamental frequency and level of the input vocal signal are read from block 112 (also shown in FIG. 4). After block 210, the subroutine proceeds to decision block 212, which determines if the level of the input vocal signal is above a predetermined threshold. The threshold value is preferably set to be greater than the level of background noise that enters the microphone 30 (shown in FIG. 3). If the level of the input vocal signal is not above the threshold, subroutine 200 proceeds to return block 214, which indicates that a new note is not beginning. As a result, the note "off" counter is incremented and the note "on"counter is cleared as shown in block 118 of FIG. 4. If the level of the input vocal signal is above the predetermined threshold, subroutine 200 proceeds to decision block 216, which determines if the input vocal signal is representative of a sibilant sound. The operation of block 216 is more fully described below. If the vocal signal is representative of a sibilant sound, the subroutine proceeds to return block 214.

If the input vocal signal is not a sibilant sound, the subroutine proceeds to decision block 218, which determines if the input vocal signal is periodic. The answer to decision block 218 is also provided by the block 112 (shown in FIG. 4). If the input vocal signal is not periodic, the subroutine proceeds to return block 214, which indicates that a new note is not beginning. If the input signal is periodic, subroutine 200 proceeds to block 219 and determines if the fundamental frequency of the input vocal signal exceeds the range capable of being sung by a human voice. Specifically, if the fundamental frequency exceeds approximately 1000 Hertz, then the subroutine returns at block 214.

Having found that fundamental frequency is in the range of a human voice, subroutine 200 proceeds from the decision block 219 and reads the note "off"counter, as shown in block 220. After block 220, subroutine 200 proceeds to decision block 224, which determines if the previous note has been "off" for a time less than or equal to 100 milliseconds. If the previous note did not end less than 100 milliseconds ago, subroutine 200 proceeds to return block 226, which indicates that a new note is being sung by the participant. As a result, the Current Note is assigned to correspond to the input vocal signal as shown in block 119 (FIG. 4) and described above. If the answer to decision block 224 is yes, meaning that the previous note did end less than or equal to 100 milliseconds ago, the subroutine 200 proceeds to decision block 225. Decision block 225 determines if there has been a large increase in the level of the input vocal signal since the last time subroutine 200 was called. If the level of the input vocal signal increases by 2, i.e., doubles, subroutine 200 proceeds to block 227, which reduces the range of acceptable frequencies as determined by block 126 in FIG. 2. In the preferred embodiment, the acceptable range is reduced from the fundamental frequency of the previous note, ±25 percent, to the fundamental frequency of the previous note, ±12.5 percent. The present method operates under the assumption that a large increase in the input vocal signal precedes a point at which it is difficult to determine the fundamental frequency. By reducing the range of acceptable frequencies, subroutine 200 avoids a "lock on" to a frequency that is not the fundamental frequency, but is instead a harmonic of the input vocal signal.

If the answer to decision block 225 is "no," or after reducing the acceptable range of frequencies in block 227, subroutine 200 proceeds to decision block 228, which determines if the fundamental frequency of the input signal is within the acceptable range (as calculated in block 126 of FIG. 4 or as reduced in block 227). If the answer to decision block 228 is "yes," subroutine 200 proceeds to return block 226 because a new note is beginning.

If the answer to decision block 228 is "no," meaning that the fundamental frequency is not within the acceptable range, subroutine 200 proceeds to decision block 230, which determines if integer multiples (2×, 3×, 4×) or fractions ($\frac{1}{2}$, $\frac{1}{3}$, $\frac{1}{4}$) of the fundamental frequency are within the acceptable range. If the answer to decision block 230 is no, subroutine 200 proceeds to return block 214 because a new note is not beginning. If the answer to decision block 230 is "yes,"meaning that an integer multiple or fraction of the fundamental frequency lies within the acceptable range, subroutine 200 proceeds to block 232, which divides or multiplies the fundamental frequency so that the result is within the acceptable range. For example, if the fundamental frequency is $\frac{1}{3}$ of the expected frequency $\pm 25$ percent, then the fundamental frequency is multiplied by 3, etc. After block 232, subroutine 200 proceeds to return block 226 because that a new note is being sung by the musician.

FIG. 6 is a detailed flow chart of "note continuing" subroutine 300 called at block 127 (shown in FIG. 4). The purpose of subroutine 300 is to determine whether the Current Note being sung by the participant is continuing or whether it has ended. Subroutine 300 begins at block 310 and proceeds to block 312, which reads the fundamental frequency and level of the input vocal signal as determined by block 112 (shown in FIG. 4). After block 312, subroutine 300 proceeds to decision block 314, which because determines if the level of the input signal exceeds the predetermined threshold. If the answer to block 314 is "no," the subroutine 300 proceeds to return block 317 because the Current Note is not continuing. As a result, note "on" counter is cleared and the note "off" counter is set to "on" as shown in block 132 of FIG. 4. If the level is above the threshold, subroutine 300 proceeds to decision block 316, which determines if the input vocal signal is representative of a sibilant sound. If the answer to decision block 316 is "yes," the subroutine 300 proceeds to return block 317. If the answer to decision block 316 is "no," subroutine 300 proceeds to decision block 318, which determines if the input vocal signal is periodic, by checking the results of block 112. If the answer to decision block 318 is "no," subroutine 300 proceeds to return block 317. If the answer to decision block 318 is "yes," subroutine 300 proceeds to decision block 319, which determines if the fundamental frequency of the input vocal sound is within the range of a human voice. Block 319 operates in the same way as block 219 (shown in FIG. 5). If the answer to decision block 319 is "no," subroutine 300 proceeds to return block 317. If the answer to decision block 319 is "yes," subroutine 300 proceeds to decision block 320.

Decision block 320 operates in the same way as block 225 (shown in FIG. 5) to determine if there is a large increase in the level of the input vocal signal. If the answer to block 320 is "yes," the range of acceptable frequencies is reduced in block 322. If either the answer to decision block 320 is "no" or after the range of acceptable frequencies has been reduced in block 322, subroutine 300 proceeds to decision block 324 that determines if the fundamental frequency of the input signal is within the acceptable range, as determined by block 126 (in FIG. 4) or as reduced in block 322. If the answer to decision block 324 is "yes," subroutine 300 proceeds to return block 326, which indicates that the note is continuing. As a result, the note "on" counter is incremented. See block 130, FIG. 4 and the preceding description. If the answer to decision block 324 is no, meaning that the fundamental frequency is not within the acceptable range, subroutine 300 proceeds to decision block 328, which determines if integer multiples ($2\times$, $3\times$, $4\times$) or fractions ($\frac{1}{2}$, $\frac{1}{3}$, $\frac{1}{4}$) of the fundamental frequency are within the acceptable range. If the answer to decision block 328 is "no," the subroutine 300 proceeds to return block 317 because the note is not continuing. If the answer to decision block 328 is "yes," subroutine 300 proceeds to block 329, which determines if there has been a jump in the octave of the input signal and updates octave up and octave down counters. An "octave up" jump is detected by a doubling of the fundamental frequency, while an "octave down" jump is detected by a halving of the fundamental frequency. A pair of counter variables, Octave Up and Octave Down, keep track of the number of times the input vocal signal jumps an octave up and down, respectively. These variables are updated in the block 329, before the subroutine proceeds to decision block 330.

The present method of analyzing input vocal signals operates by keeping track of the number of times the fundamental frequency determined by block 112 jumps an octave. For example, if the participant begins to sing a word that begins with a "W" at A-440 Hertz, the fundamental frequency may begin at A-220 Hertz, jump to A-440 Hertz, back to A-220 Hertz, up to A-880 Hertz, etc. The two variables, Octave Up and Octave Down, keep track of the number of times the fundamental frequency jumps an octave from A-440 Hertz. Because the present method has no way of knowing which of the octaves A-220 Hertz, A-440 Hertz, or A-880 Hertz is the correct frequency being sung by the participant, an initial estimate is made. The initial estimate is assumed to be correct but is allowed to change either up or down for the first six times through subroutine 300. After the note has been "on" for between 100–200 milliseconds, it is necessary for the method to "lock on" or choose one of the octaves. However, after about 200 milliseconds, if the ratio of the number of times the fundamental frequency drops an octave, as compared to the length of time the note has been on, exceeds 50 percent, then the method needs to determine whether an octave error has been made and, thus, that the wrong choice for the octave was made initially.

Decision block 330 determines if the Current Note has been on for a time greater than or equal to 200 milliseconds, as determined by the note "on" counter. If the answer to decision block 330 is "no," then subroutine 300 proceeds to return block 326 because the Current Note is continuing. Upon returning to block 119 (shown in FIG. 4), the variable Current Note is updated to reflect the new fundamental frequency. If the answer to decision block 330 is yes, subroutine 300 proceeds to decision block 334, which determines a ratio of the count in the Octave Down counter to the time the Current Note has been on. If this ratio exceeds 50 percent, subroutine 300 proceeds to block 336, which reads the .results of the octave error subroutine 400 called for in block 111 in FIG. 4.

If the answer to decision block 334 is no, subroutine 300 proceeds to block 335 which calculates a ratio of the count in the Octave Up counter to the time Current Note has been on. If this ratio does not exceed 50 percent, then subroutine 300 proceeds to block 332, which corrects the fundamental frequency. For example, if the six readings had indicated that the fundamental frequency was 440 Hertz and then the fundamental frequency was determined to be 880 Hertz, the ratio of the Octave Up counter to the note "on" counter would not exceed 50 percent and the 880 Hertz reading would be divided by two. After block 332 the subroutine proceeds to return block 326. If the answer to decision block 335 is "yes," then it is assumed that the fundamental frequency is the correct fundamental frequency and an error was made initially when the Current Note was assigned a value. Therefore, the subroutine 300 proceeds to block 337 that clears the note "on" and octave counters before proceeding to return block 326. Upon returning, the Current Note will be updated to reflect the new higher octave.

If the answer to decision block 334 is "yes," then subroutine 300 proceeds to block 336, which reads the result of the octave error subroutine. The results of the octave error subroutine are tested in decision block 338. If there is not an octave error (i.e., initial estimate of the octave of the input vocal signal was correct), then the fundamental frequency just determined is an octave lower than the actual fundamental frequency of the input vocal signal. Therefore, the frequency is multiplied by two in block 332. If there is an octave error, then it is assumed that the fundamental frequency just determined is the correct fundamental frequency and the subroutine proceeds to return block 326 and the initial estimate of the octave that the participant was singing was incorrect. Therefore, the note "on" counter and octave counters are cleared in block 337 before returning to block 326 so that the new fundamental frequency will now be assigned to the variable Current Note.

Figure 7:
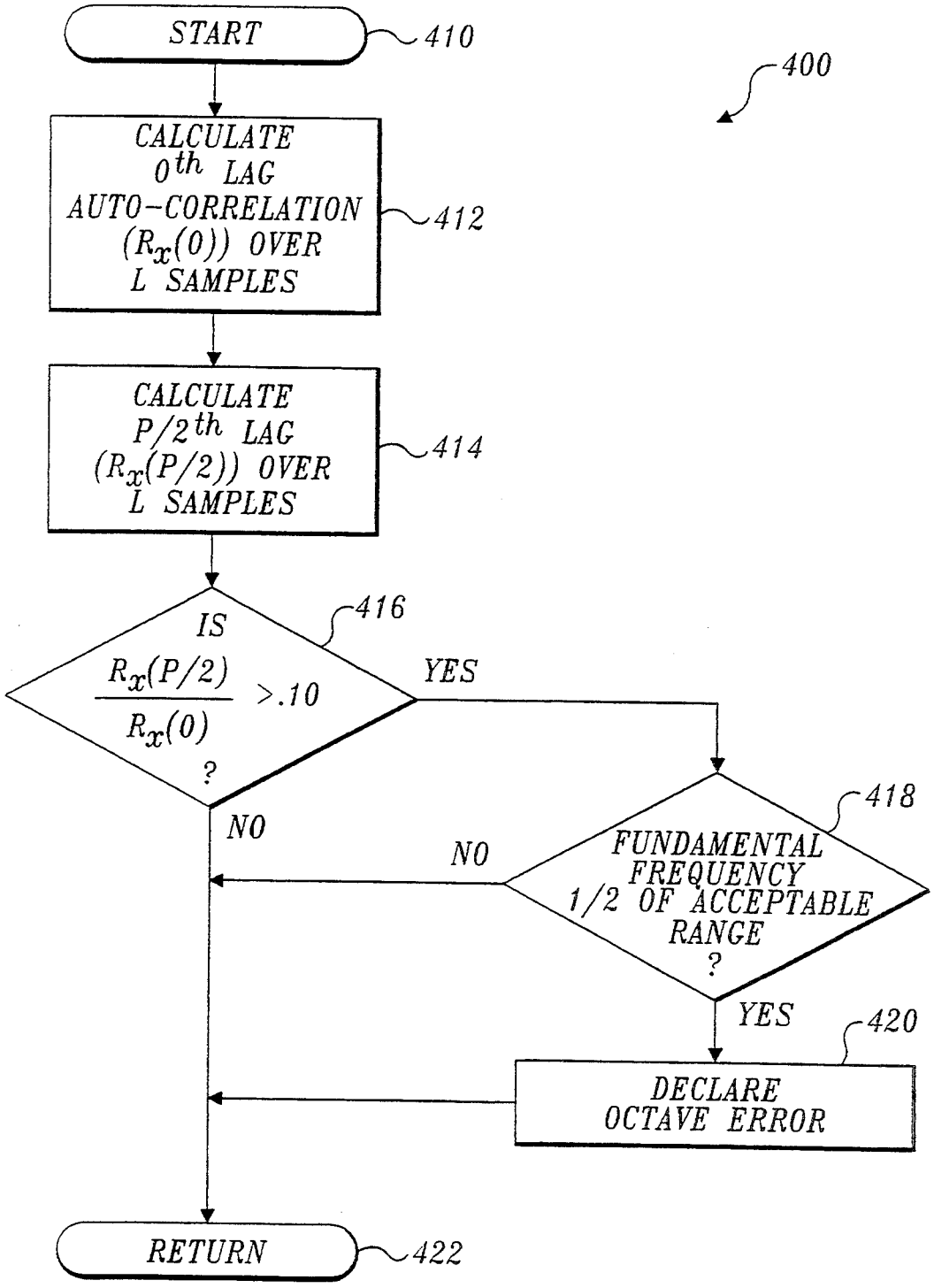
FIG. 7 is a flow chart showing the steps of a method for detecting octave errors used in the method according to the present invention.

Turning now to FIG. 7, a detailed flow chart showing the operation of the octave error subroutine 400 (referenced in FIG. 2) is shown. Subroutine 400 begins at start block 410 and proceeds to block 412, which calculates the 0th lag autocorrelation ($R_x(0)$) of the input vocal signal for a period of L samples. In the preferred embodiment, L is set equal to 256. The 0th lag autocorrelation is determined using the formula given in Equation 1:

$$R_x(0) = \sum_{n=0}^{L-1} x(n) \cdot x(n) \tag{1}$$

where x(n) is the input vocal signal stored in the circular array within the RAM 44 (shown in FIG. 3). After block 412, subroutine 400 proceeds to block 414 wherein the P/2th lag autocorrelation $R_x(P/2)$) is calculated according to Equation 2:

$$R_x(P/2) = \sum_{n=0}^{L-1} x(n) \cdot x(n - P/2) \tag{2}$$

wherein P is the period of the fundamental frequency of the input vocal signal. If the ratio of the 0th autocorrelation to the P/2th lag autocorrelation exceeds 0.10 as determined by a decision block 416, subroutine 400 proceeds to decision block 418 that determines if the fundamental frequency is half of the acceptable range, i.e., an octave lower than expected. If the answer to decision block 418 is yes, subroutine 400 proceeds to block 420, which declares an octave error. If the answer to either decision blocks 416 or 418 is no, subroutine 400 proceeds directly to return block 422. Subroutine 400, in effect, compares the magnitude of the fundamental frequency of the input vocal signal to the magnitude of the even harmonics. Because an octave error is typically indicated by a large value of the even harmonics, as compared to the fundamental frequency, the ratiometric determination can be made, and the initial estimate of fundamental frequency then corrected to reflect the actual fundamental frequency of the input vocal signal.

Figure 8:
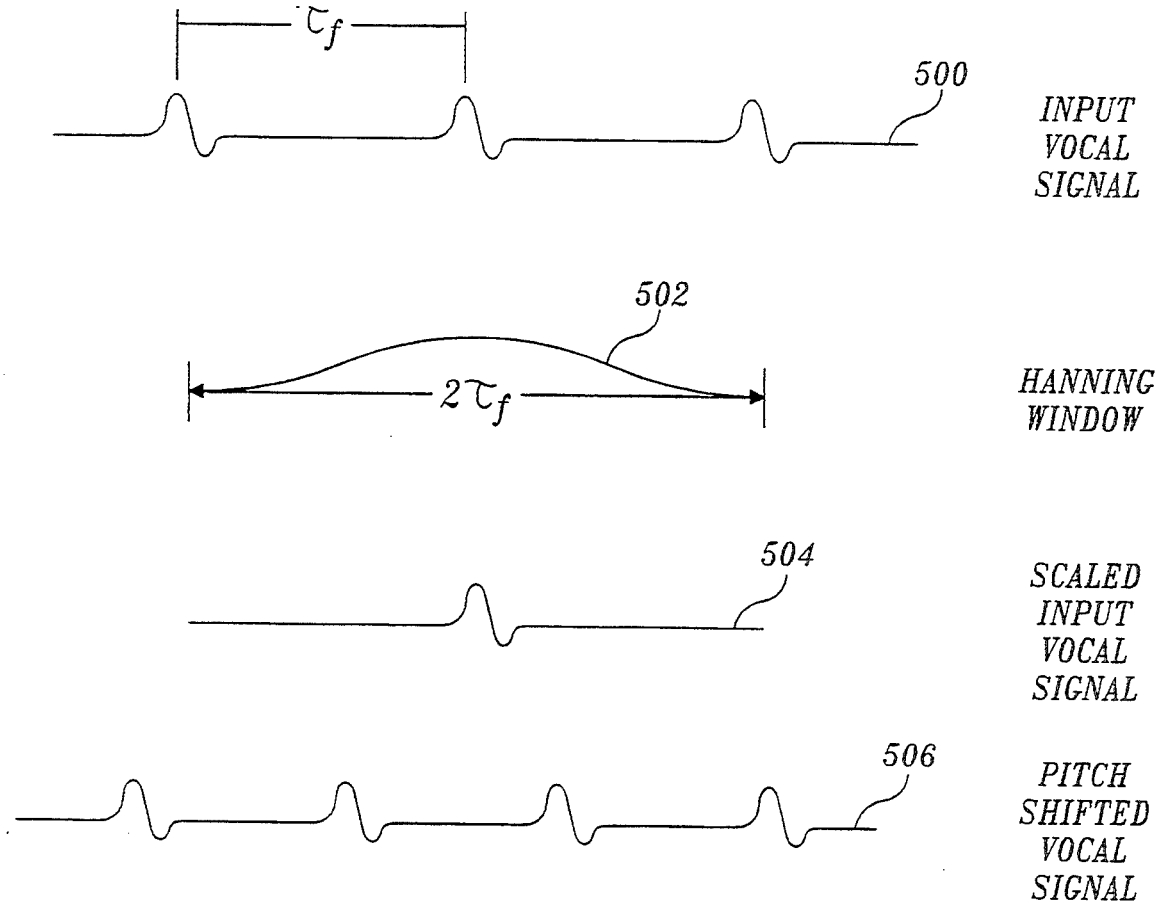
FIG. 8 is a diagram showing how the pitch of vocal signal is changed according to the present invention.

FIG. 8 is a diagram showing how the method of the present invention creates a pitch-shifted vocal signal. The input vocal signal 500 is shown having a period $\tau_f$. A portion of the input vocal signal is extracted by multiplying the signal by a window 502 having a duration preferably equal to twice the period $\tau_f$. In the preferred embodiment, the window is shaped to be an approximation of a Hanning window in order to reduce high-frequency noise in the pitch-shifted output vocal signal. However, other smoothly varying functions may be employed. The result of multiplying the input vocal signal 500 by the window 502 is shown as a scaled input vocal signal 504. As can be seen, the scaled input vocal signal is substantially zero everywhere except under the bell-shaped portion of window 502. Therefore, what has been extracted from input vocal signal 500 is a portion having a duration of twice the period $\tau_f$.

A pitch-shifted vocal signal 506 having an increased pitch is produced by replicating the scaled input vocal signal 504 at a rate of fundamental frequency of Reference Note. By adjusting the rate at which the scaled input vocal signal 504 is replicated, the pitch of the input vocal signal can be varied without altering the shape of the spectral envelope of the input vocal signal, as discussed above.

Figure 9:
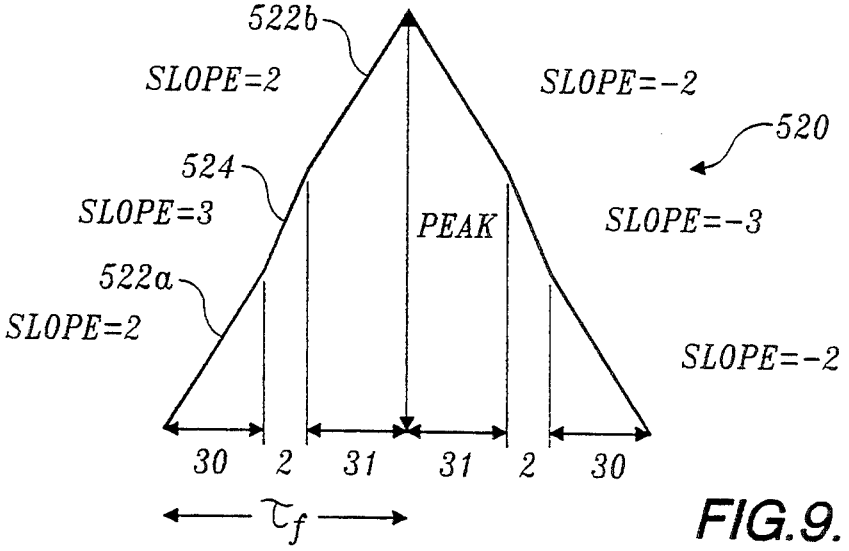
FIG. 9 shows the steps used to generate a piecewise linear approximation of a Hanning window according to the present invention.

Because a Hanning window 502 shown in FIG. 8 is computationally difficult to compute in real time with a simple microprocessor, the present method approximates a Hanning window using a piecewise linear approximation. FIG. 9 shows how the approximation of the window function 520 is computed. For purposes of illustration, it is assumed that the period $\tau_f$ of the fundamental frequency of the input vocal signal is 63. This number is obtained from the block 112 shown in FIG. 4, according to the method disclosed in U.S. Pat. No. 4,688,464 as described earlier. The piecewise linear approximation isgenerated using two lines 522 and 524, each having a different slope and a different duration. The line 522 is broken into two segments **522*a* and 522*b*, with the second line 524 disposed between them. The slope of line 522 is designated as $Slope_1$, while the slope of line 524** is designated as $Slope_2$. The calculations of the slopes and durations are given by Equations 3–6:

$$Slope_1 = Int(Peak/\tau_f) \tag{3}$$

$$Slope_2 = Slope_1 + 1 \tag{4}$$

$$duration\ of\ Slope_2 = Peak - (\tau_f slope_1) \tag{5}$$

$$duration\ of\ Slope_1 = \tau_f - duration\ of\ Slope_1 \tag{6}$$

The variable Peak is a predefined variable and in the preferred embodiment equals 128. Applying these equations to the piecewise linear approximation 520 (shown in FIG. 9) results in the slope of 2 for line 522 and a slope of 3 for line 524. The duration of the segment **522*a* is 30, the duration of segment 522*b* is 31, and the duration of line 524 is 2. Any odd durations are always added to line 522*b*. The second half of the piecewise linear approximation 520** is made by providing a mirror image of the left half, having the same durations, but with negative slopes. By using only slopes having integer values, the multiplication operations needed to extract a portion of the waveforms are simpler and, thus, enable the present method to operate substantially in real time, with an inexpensive microprocessor. Furthermore, noninteger slope values would introduce unwanted high-frequency modulations to the pitch-shifted vocal signal.

Figure 10:
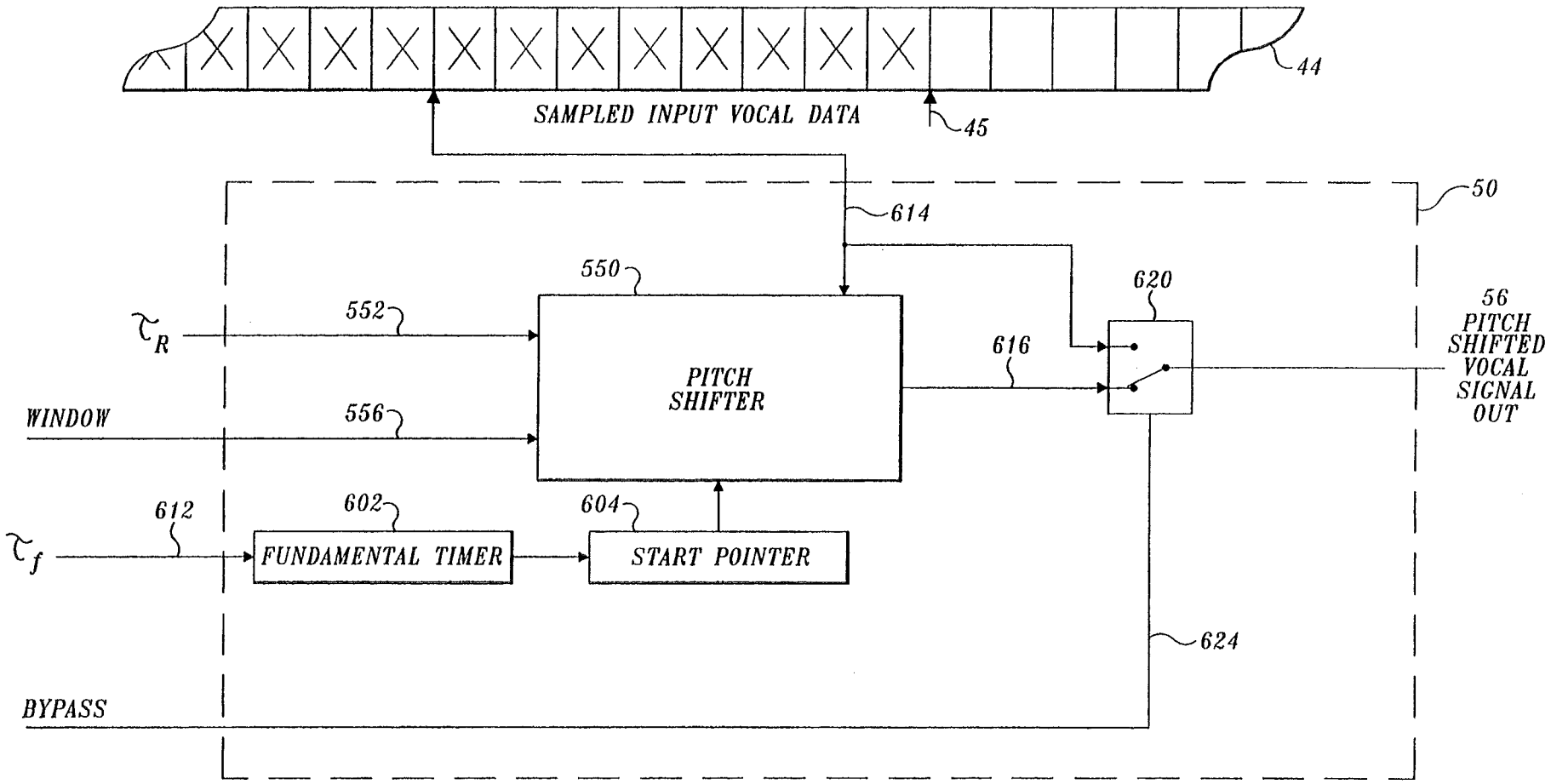
FIG. 10 is a block diagram of a signal processor chip that is included in the pitch corrector in accordance with the present invention;.

FIG. 10 shows a block diagram of the signal processor block 50 as (shown in FIG. 3). Signal processor block 50 produces the pitch-shifted vocal signal, having a pitch equal to the pitch of the Reference Note. A pitch shifter 550 is used to replicate the scaled input vocal signals at a rate equal to the fundamental frequency of the Reference Note. The pitch shifter 550 receives the period of the Reference Note from the microprocessor on a lead 552. Also supplied to the pitch shifter 550 on lead 556 from the microprocessor is a mathematical description of the piecewise linear approximation of the Harming window. The period, $\tau_f$, of the fundamental frequency of the input vocal signal is applied to a fundamental timer 602 on lead 612. The lead 612 is also coupled to the microprocessor 40. The fundamental timer 602 is set to time a predetermined interval by loading it with an appropriate number.

By loading the fundamental timer 602 with the period $\tau_f$ of the fundamental frequency of the input vocal signal, the fundamental timer 602 times an interval having the same duration as the period of the fundamental frequency of the input signal. Each time the fundamental timer times its interval, a start pointer 604 is loaded with the start address in RAM 44 from where the portion of the input vocal signal is to be retrieved.

As described above, RAM 44 is configured as a circular array in which the input vocal data are stored. A write pointer 45 is always updated to indicate the next available location in memory in which input vocal data can be stored. The present method assumes that the pitch detection subroutine (shown as block 112 in FIG. 4) takes about 20 milliseconds to complete its determination of the fundamental frequency of the input signal. Therefore, the point within the circular array from which the input vocal signal is to be retrieved can be determined by subtracting the number of samples of the input vocal signal taken in 20 milliseconds from the address of the write pointer 45. Thus, the fundamental timer 602 and the start pointer 604 operate together to determine the start address in RAM 44 from which input vocal signal is to be extracted. Each time the fundamental timer 602 times an interval equal to the period $\tau_f$, the start pointer 604 is updated to be the address at the write pointer 45 less 20 milliseconds multiplied by the rate at which the input vocal signal is sampled.

The pitch shifter 550 multiplies the input vocal dam stored in RAM 44 by the window function. The pitch shifter 550 receives the sampled input vocal data on lead 614 (connected to the lead 46) and outputs the result on a leads 616. A switch 620 connects the output of signal processor block 50 to a lead 56 The switch 620 is controlled by a bypass signal transmitted on lead 624 from the microprocessor. If a note is not detected (due to sibilance, low level, etc.), the lead 56 receives the sampled input vocal signal from lead 614 directly, and the pitch shifter 550 is bypassed. As stated above, in order to make the pitch-shifted vocal signal sound natural, the pitch of a sibilant sound should not be shifted.

Figure 11:
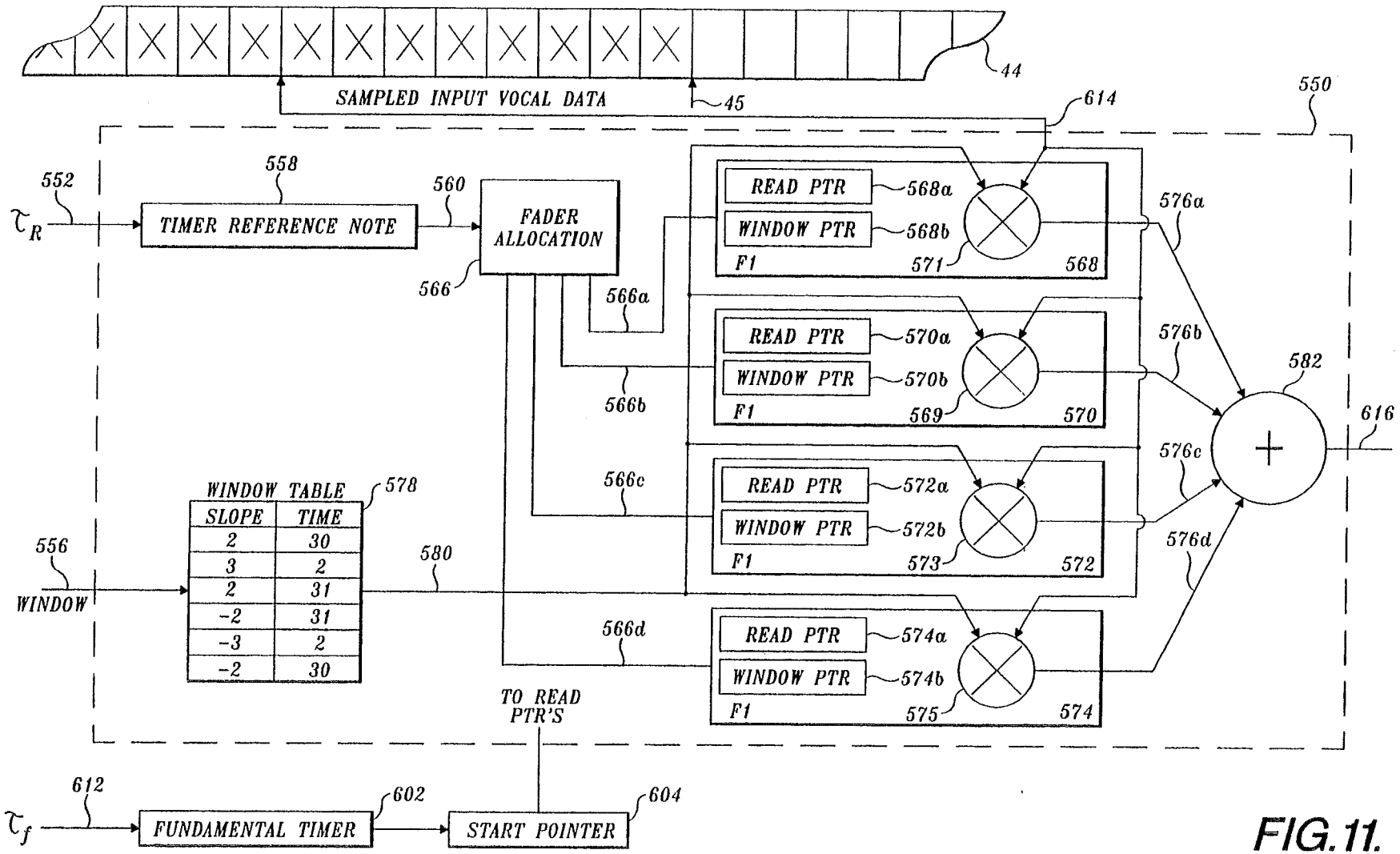
FIG. 11 is a block diagram of a pitch shifter included within the signal processor chip.

FIG. 11 shows a detailed block diagram of the shifter 550, as shown in FIG. 10. As stated above, and shown in FIG. 8, the pitch of the input vocal signal is shifted by replicating the scaled input vocal signal at a rate equal to the fundamental frequency of the Reference Note. Included within the pitch shifter 550 is a timer 558, which is loaded with the period of the Reference Note. The timer 558 times an interval equal to the period of the Reference Note. As the timer 558 times an interval equal to the period of the Reference Note, $\tau_R$, a signal is sent on lead 560 to fader allocation block 566. The fader allocation block 566 triggers one of four faders 568, 570, 572, and 574 to begin generating a portion of pitch-shifted output signal by multiplying the sampled input vocal signal by the window function. The fader allocation block 566 is coupled to the faders by a set of leads 566*a*, 566*b*, 566*c*, and 566*d*.

Included within each of the faders 568, 570, 572, and 574, respectively, is a read pointer 568*a*, 570*a*, 572*a*, and 574*a* and a window pointer 568*b*, 570*b*, 572*b*, and 574*b*. Each time a fader is requested, the current value of the start pointer 604 is loaded into the read pointer of the triggered fader to indicate the start address in RAM 44 from where the sampled input vocal signal is to be read. The window pointers 568*b*, 570*b*, 572*b*, and 574*b* keep track of the part of the piecewise linear approximation of the window function that is to be multiplied by the input vocal data. The pitch shifter 550 includes a window table 578 that contains a mathematical description of the piecewise linear approximation of the window. The window table 578 is coupled to each of the faders by lead 580. Each fader included within the pitch shifter operates in the same manner. Therefore, the following description of fader 568 applies equally to the other faders.

Assume for example that the Reference Note has a fundamental frequency of 440 Hz and that the input vocal signal has a fundamental frequency of 420 Hz. Therefore, the participant is singing flat compared to the Reference Note. The period of the fundamental frequency of the Reference Note $\tau_R$ equals 2.27 milliseconds while the period of the fundamental frequency of the input vocal signal $\tau_f$ equals 2.38 milliseconds. The fundamental timer 602 is set to time intervals of 2.38 milliseconds. Therefore, the start point is continually updated to be the current address of the write pointer 45 - (2.38 milliseconds * the sampling rate of the A/D converter 36 shown in FIG. 3). The Reference Note timer is set to time an interval equal to 2.27 milliseconds. Therefore, every 2.27 milliseconds an available fader begins multiplying a portion of the stored input vocal signal by the window function. The results of the multiplication are output from the four faders to summer 582, where the signals are combined to create a pitch-shifted vocal signal. The faders read the stored input vocal signal at a rate equal to the sampling rate of the A/D converter 36. If the pitch of the Reference Note is higher than the pitch of the input vocal signal, then parts of the scaled input vocal signal will overlap. Similarly, if the pitch of the Reference Note is lower than the pitch of the input vocal signal, the signal on lead 616 will include some "dead space." In either case, a pitch-shifted output signal sounds natural.

Because the window function is chosen to have a duration equal to twice the fundamental frequency of the input vocal signal, two faders are required to reproduce the input vocal signal with no shift in pitch. Only one fader is required to produce an output signal having a pitch that in an octave below the pitch of the input vocal signal, while four faders are required to produce an output vocal signal having a pitch that in an octave above the pitch of the input vocal signal. It is possible to alter the window function to have a duration less than two periods of the input vocal signal in order to reduce the number of faders required; however, such a reduction in the window duration results in a corresponding decrease in audio quality. The operation of multiplying a signal by a Hanning window to create a pitch-shifted signal is fully described in the Lent paper referenced above.

Figure 12:
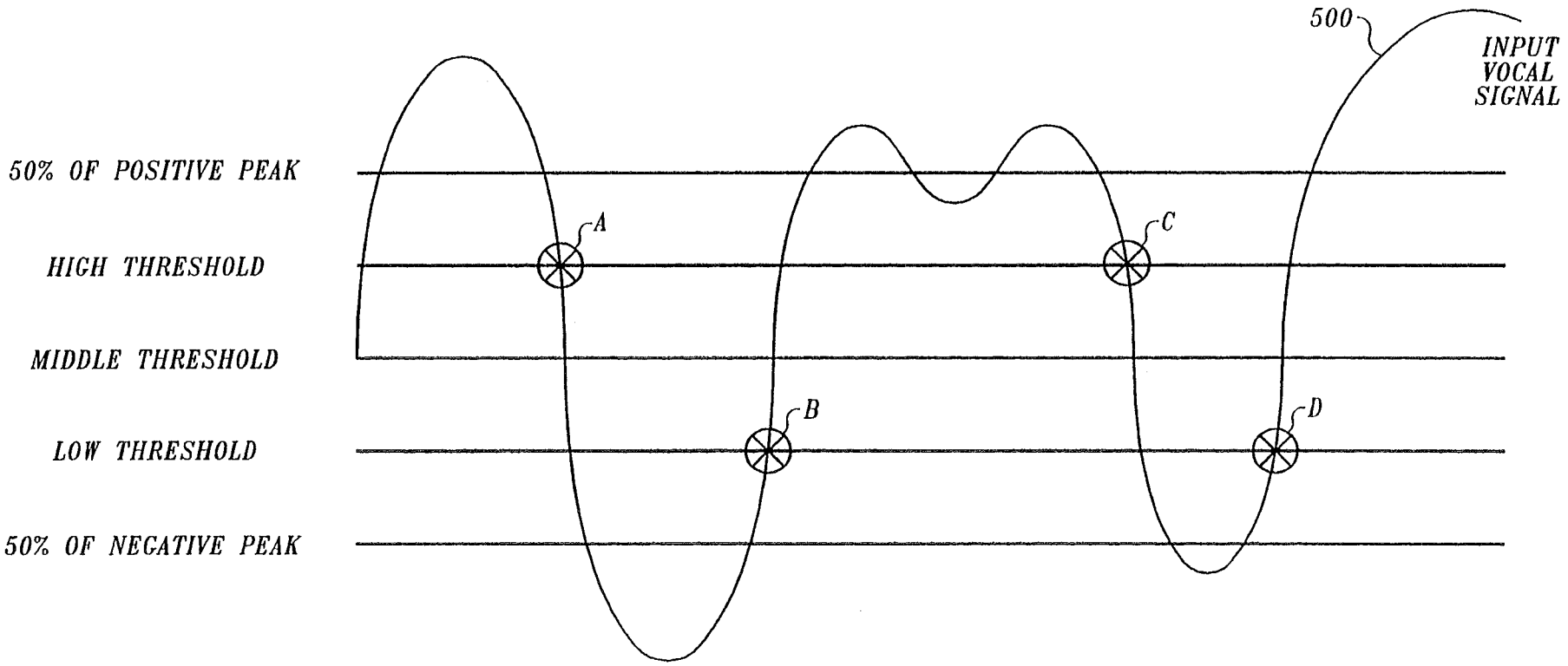
FIG. 12 is a graph of an input vocal signal that is representative of a sibilant sound.

FIG. 12 shows a graph of an input vocal signal 500 crossing a series of predefined thresholds used by subroutine 112 to detect a sibilant sound. As stated above, sibilant sounds are recognizable in the input vocal signal by the presence of large-amplitude, high-frequency variations. The method of pitch detection disclosed in U.S. Pat. No. 4,688,464 is altered in the present invention. Two thresholds at 50 percent of the positive peak value and 50 percent of the negative peak value are determined. The prior method is also altered so that a record is made each time the input vocal signal completes the following sequence: crossing the high threshold, the threshold at 50 percent of the peak value, and recrossing the high threshold. The method by which the threshold values are determined is fully described in the '464 patent. In FIG. 12, this sequence is shown completed at points A and C. Similarly, the method also records each time the input vocal signal completes the sequence of crossing the low threshold, the threshold at 50 percent of the negative peak, and recrossing the low threshold. Completions of this sequence are shown as points B and D. If 16–160 of these occurrences are detected in less than 8 milliseconds, the method assumes that a sibilant sound has been detected, so that the bypass line to the pitch shifter is enabled, thereby bypassing the pitch shifter as described above. In the preferred embodiment of the pitch corrector, the number of sequences required to signal a sibilant sound is adjustable.

Figure 13:
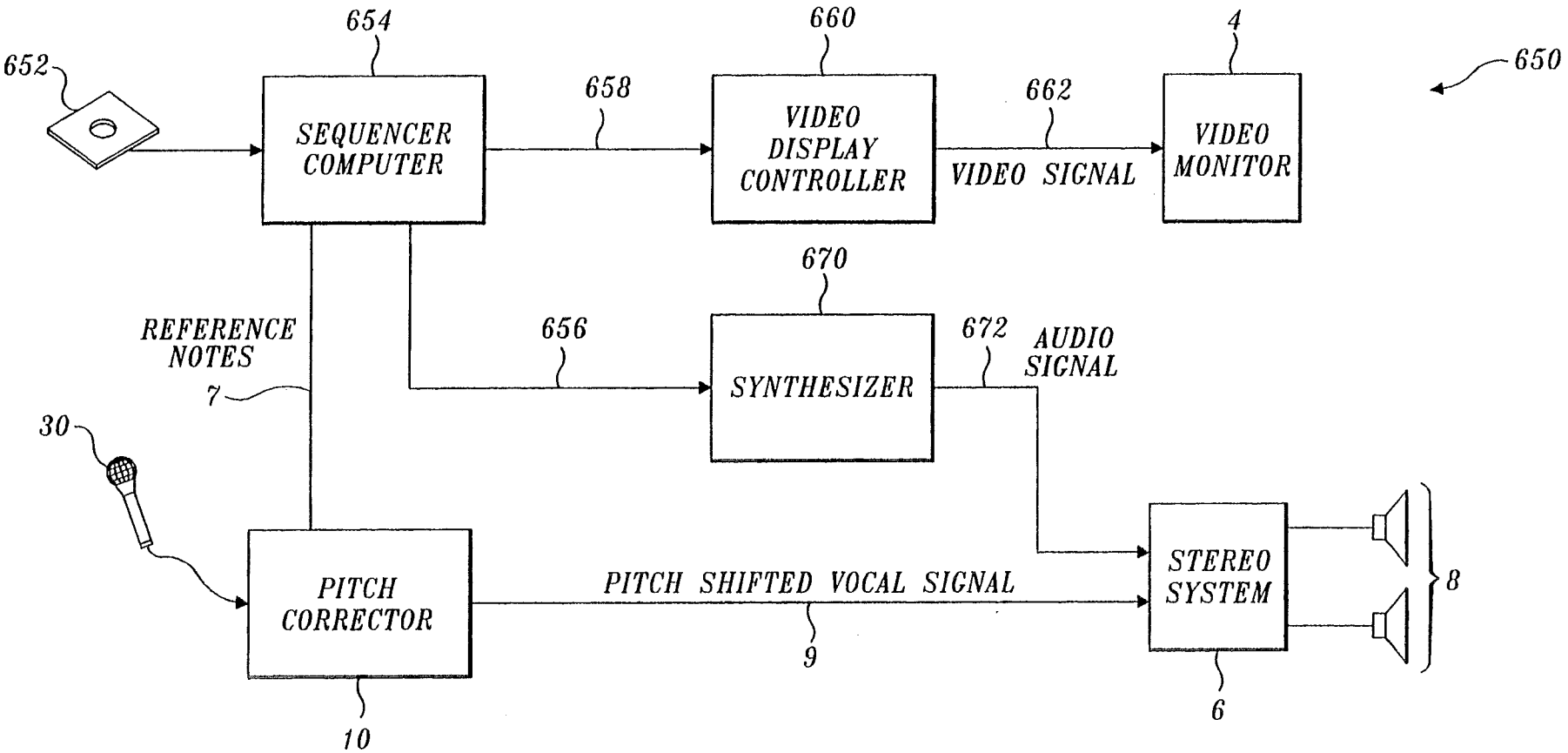
FIG. 13 is a block diagram of a second embodiment of a karaoke entertainment system according to the present invention.

Turning now to FIG. 13, an alternate embodiment of an entertainment system 650 is shown. The entertainment system includes a sequencer computer 654, a video display controller 660 and a synthesizer 670. In this embodiment a computer storage disk, ROM card or other source of digital data 652 stores the words of a particular song to be played in a computer readable form such as ASCII as well as the accompaniment stored in a digital format. The sequencer computer includes a disk drive, a microprocessor and memory (not shown). The sequencer computer has three output leads; a first lead 658 is connected to an input of the video display controller 660. The sequencer computer reads the words of the song from the computer storage disk and transfers them in ASCII format to the video display controller 660. The video display controller drives the video monitor 4 to display the words of the song as they are to be sung. A second lead 656 of the sequencer computer is connected to the synthesizer 670. The accompaniment signal is transmitted in a suitable digital format to the synthesizer, causing the synthesizer to play the accompaniment as is well known to those skilled in the musical electronics art. Finally, the sequencer computer is connected to the pitch corrector 10 by a lead 7. The sequencer computer reads a melody track on the computer storage device 652. The melody track contains the stored Reference Notes that indicate the proper pitch of the notes as they are to be sung in the song. The sequencer computer reads the melody track and transfers the Reference Notes to the pitch corrector 10 so that the pitch corrector can shift the pitch of the input signal to the pitch of the Reference Notes according to the method described above.

While the preferred embodiment of the invention has been illustrated and described, it will be appreciated that various changes can be made therein without departing from the spirit and scope of the invention. For example, the sequencer computer 654, video display controller 660, synthesizer 670 and pitch corrector 10 may be separate units or may be combined as a single computer or video game system that accepts a cartridge containing the accompaniment, lyrics and Reference Notes of one or more songs to be played. Therefore, it is intended that the scope of the invention be determined from the following claims.

The embodiments of the invention in which an exclusive property or privilege is claimed are defined as follows:

1. A method for shifting a pitch of an input vocal signal sung by a user of a karaoke system such that the input vocal signal is on key with a prerecorded song played by the karaoke system, the method comprising the steps of:

sampling the input vocal signal;

storing the sampled input vocal signal in a digital memory;

analyzing the stored input vocal signal to determine the pitch of the input vocal signal;

reading a code, stored with the prerecorded song, that defines a pitch of a reference note, said pitch of the reference note defining the pitch at which the input vocal signal should be sung in order to be on key with the prerecorded song; and shifting the pitch of the input vocal signal to be substantially equal to the pitch of the reference note by scaling the stored input vocal signal by a window function and replicating the scaled input vocal signal at a rate that is a function of a fundamental frequency of the reference note.

2. The method of claim 1, wherein said prerecorded song is stored on a laser disk and wherein the step of reading a code that is stored with the prerecorded song that defines a pitch of the reference note comprises the step of:

reading a subcode stored on the laser disk, said subcode indicating the fundamental frequency of the reference note.

3. The method of claim 1, wherein said prerecorded song is stored on a videotape and wherein the step of reading a code that is stored with the prerecorded song that defines a pitch of the reference note comprises the step of:

reading a subcode stored on videotape, said subcode indicating the fundamental frequency of the reference note.

4. The method of claim 1, further comprising the step of:

combining the pitch shifted input vocal signal and prerecorded song; and playing the combined pitch shifted input vocal signal and prerecorded song on the karaoke system.

5. The method of claim 1, wherein the step of scaling the stored input vocal signal comprises the step of multiplying a portion of the stored input vocal signal by a smoothly varying function.

6. The method of claim 5, wherein the smoothly varying function is a piece-wise linear approximation of a Hanning window.

7. An apparatus for shifting the pitch of an input vocal signal sung by a user of a karaoke machine so that the pitch of the input vocal signal is on key with a prerecorded song played by the karaoke machine, comprising:

a microphone for creating an electrical signal representative of the input vocal signal;

an analog-to-digital converter connected to receive the electrical signal produced by the microphone for producing a digitized input vocal signal representative of the singer's voice;

a digital memory for storing the digitized input vocal signal;

computing means for determining the pitch of the digitized input vocal signal;

means for receiving a code that indicates a pitch of a reference note at which the pitch of the input vocal signal should be sung to be on key with the prerecorded song played by the karaoke machine; and a pitch shifter for shifting the pitch of the digitized input vocal signal to equal to the pitch of the reference note.

8. The apparatus of claim 7, wherein the code that indicates the pitch of a reference note is stored in a MIDI format.

9. The apparatus as in claim 7, wherein said prerecorded song is stored on a storage device that includes:

a series of codes that indicate a pitch of a series of reference notes at which the pitch of the input vocal signal should be sung to be on key with the,-prerecorded song.

10. The apparatus as in claim 9, further comprising:

a mixer for combining the pitch shifted input vocal signal and the prerecorded song played by the karaoke system.

11. The apparatus as in claim 9, wherein said storage device comprises a laser disk.

12. The apparatus of claim 11, wherein the codes that indicate the pitch of the reference notes are stored as subcodes on the laser disk.

13. The apparatus as in claim 9, wherein said storage device comprises a videotape.

14. The apparatus of claim 13, wherein the codes that indicate the pitch of the reference notes are stored as subcodes on the videotape.

15. The apparatus as in claim 9, wherein said storage device comprises a ROM card.

16. In a karaoke machine including a storage device having stored thereon a prerecorded song and a set of lyrics to be sung to the prerecorded song, a microphone into which a participant sings, a sound system for playing the prerecorded song and a video display on which the lyrics are displayed, the improvement comprising:

a series of codes stored on the storage device that are indicative of the pitch of a series of reference notes at which the lyrics are to be sung;

means for reading the series of codes and for supplying the codes to a pitch corrector, the pitch corrector including:

an analog-to-digital converter that samples an input vocal signal sung into the microphone thereby creating a digitized input vocal signal;

a pitch detector for determining the pitch of the digitized input vocal signal; and a pitch shifter for shifting the pitch of the digitized input vocal signal to create an output signal having a pitch that is substantially equal to the pitch of the reference note; and a mixer for combining the output signal with the prerecorded song such that the combined output signal and prerecorded song are played by the sound system.

17. A method for shifting a pitch of an input vocal signal sung by a user of a karaoke system such that the input vocal signal is on key with a prerecorded song played by the karaoke system, the method comprising the steps of:

creating an electrical signal representative of the input vocal signal;

sampling the electrical signal to create a digitized input vocal signal;

storing the digitized input vocal signal in a digital memory;

analyzing the stored input vocal signal to determine the pitch of the input vocal signal;

reading a code, stored with the prerecorded song, that defines a pitch of a reference note, said pitch of the reference note defining the pitch at which the input vocal signal should be sung in order to be on key with the prerecorded song; and shifting the pitch of the input vocal signal to be substantially equal to the pitch of the reference note by scaling the stored input vocal signal by a window function and replicating the scaled input vocal signal at a rate that is a function of a fundamental frequency of the reference note.

18. In a karaoke machine including a storage device having a prerecorded song stored thereon, a microphone into which a participant sings and a sound system for playing the prerecorded song, the improvement comprising:

the storage device having a series of codes that are indicative of a series of reference notes;

means for reading the series of codes and for supplying the codes to a pitch corrector, the pitch corrector including:

an analog-to-digital converter that samples the input vocal signal sung into the microphone thereby creating a digitized input vocal signal;

a pitch detector for determining the pitch of the digitized input vocal signal;

a pitch shifter for creating a pitch shifted output signal having a pitch substantially equal to the pitch indicated by a note of the series of reference notes; and a mixer for combining the pitch shifted output signal with the prerecorded song such that the pitch shifted output signal and the prerecorded song are played by the sound system.

* * * * *